United States Patent [19]

Meintzer et al.

[11] 4,210,328

[45] Jul. 1, 1980

[54] TABLE-TOP BASKETBALL GAME

[76] Inventors: Eddie R. Meintzer, 4520 Carlisle NE., Albuquerque, N. Mex. 87109; Paul M. Inglat, 10904 Rio Puerco SW., Albuquerque, N. Mex. 87105; Zenon J. Zamora, 1008 Broadway SE., Albuquerque, N. Mex. 87102

[21] Appl. No.: 924,750

[22] Filed: Jul. 13, 1978

Related U.S. Application Data

[63] Continuation-in-part of Ser. No. 834,339, Sep. 19, 1977, abandoned.

[51] Int. Cl.[2] ..... A63F 7/06

[52] U.S. Cl. ..... 273/85 R; 273/342

[58] Field of Search ..... 273/85 R, 85 A, 176 B, 273/95 H, 105 R; 46/31

[56] References Cited

U.S. PATENT DOCUMENTS

| | | | |
|---|---|---|---|
| 775,090 | 11/1904 | Pilz | 46/31 X |
| 3,689,069 | 9/1972 | Rogers | 273/85 R |

FOREIGN PATENT DOCUMENTS

| | | | |
|---|---|---|---|
| 289615 | 5/1928 | United Kingdom | 46/31 |

OTHER PUBLICATIONS

"Par Golf," 1965 Golf Supplies, Milan, Illinois, pp. 18 & 19.

*Primary Examiner*—George J. Marlo

*Attorney, Agent, or Firm*—Clarence A. O'Brien; Harvey B. Jacobson

[57] ABSTRACT

A flat, rectangular game board is provided having standard basketball markings imprinted thereon. Four upstanding walls are positioned about the periphery of the game board in continuous relation to one another. The walls which extend bove the shorter sides of the rectangle have one hoop attached to each with a basket depending from the hoop. Contestants may toss a small ball into the box formed by the game board and the sides with the object of the game being to have the ball bounce as many times as possible off the game board and/or the sides and thereafter to enter the hoop positioned above the opponent's side of the game board. The walls are hingedly interconnected for folding into side-by-side relation for storage. Right angle clips are provided to engage the walls at opposite corners to retain the walls in their upstanding use position.

3 Claims, 6 Drawing Figures

TABLE-TOP BASKETBALL GAME

CROSS-REFERENCE TO RELATED APPLICATION

This application is a continuation-in-part of U.S. application Ser. No. 834,339, filed Sept. 19, 1977 now abandoned.

BACKGROUND OF THE INVENTION

1. Field of the Invention

This invention relates to the field of amusement devices and more specifically with recreational games simulative of basketball in which a number of players attempt to manipulate a ball through a basket to accumulate points.

2. Description of the Prior Art

Amusement devices employing a ball and a basket in which the object of the game is to throw the ball into a basket are already known in the prior art. For example, U.S. Pat. No. 3,689,069, issued Sept. 5, 1972, to Rogers, shows a basketball amusement device whereby players toss a small ball onto the game board in an attempt to have the small ball bounce off the surface of the game board and into a net which extends outwardly from a wall which projects upwardly from the surface of the game board. In this particular game, the players are required only to bounce the ball from the surface of the game board and bouncing from the walls of the game board is not contemplated. U.S. Pat. No. 3,643,954, issued Feb. 22, 1972, to Meyer et al, contemplates a generally dished concave playing surface having peripheral border recesses wherein a small ball-like playing piece is launched into the recesses with a driven playing piece launching device. This game relies upon the mechanical attributes of a launching device to provide the player with the ability to land the ball in a recess. This device lacks the necessary requirements to develop a player's skill in shooting the ball. U.S. Pat. No. 3,976,296, issued Aug. 24, 1976, to Smith, shows a magnetic game apparatus whereby a ball member having at least one magnetic element therein is manipulated by the rotary movement of a disk member positioned below the game board and carrying a plurality of magnetic members thereon. This device contemplates no bouncing of the ball on the game surface and thus is quite dissimilar from the instant invention. U.S. Pat. No. 2,872,193, issued Feb. 3, 1959, to Hamilton, presents an invention wherein an apparatus involving skill in the operation thereof may be automatically varied in accordance with the results obtained in order to allow for variations in skill of the competing players. U.S. Pat. No. 2,611,615, issued Sept. 23, 1952, to Watson et al, provides a basketball type game to be played with tiddledy-winks and dice. This game does not provide for the use of a bouncing ball or side walls off of which a ball may be bounced. U.S. Pat. No. 1,608,721, issued Nov. 30, 1926, to Clark, shows a hand-manipulated basketball game wherein a rubber ball is rolled across the surface of a playing board in an attempt to have the ball enter and remain in a hole from which a slot at the basket may be attempted. No walls are provided from the game board and no bouncing of the ball from the walls is contemplated.

SUMMARY OF THE INVENTION

The present invention makes use of a playing board having walls which rise up on all sides of the board.

Players throw a small ball from a position exterior of the playing board in an attempt to have the ball bounce as many times as possible from the playing board or the walls surrounding the playing board before entering a small basket attached to one of the end walls.

A primary object of the present invention is to provide a game whereby skill of the player is involved and whereby the skill of the player is necessary to score points directly rather than through manipulation of a small machine-type throwing device.

A further object of the present invention is to provide a basketball type game device which is inexpensive to manufacture and is also easily set up for use by the players of the game.

Yet a further object of the present invention is to provide a game of the basketball type wherein the ability of a player to predict the movement of a ball is used. This ability is used by the player to both bounce the ball off the game board as well as bank it off walls surrounding the game board. Additionally, provision is made for the addition of a revolving wall which may be placed at any point on the game board to add interest to the game.

A still further object of the present invention is to provide a game apparatus which may be easily folded into a convenient compact configuration for storage.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
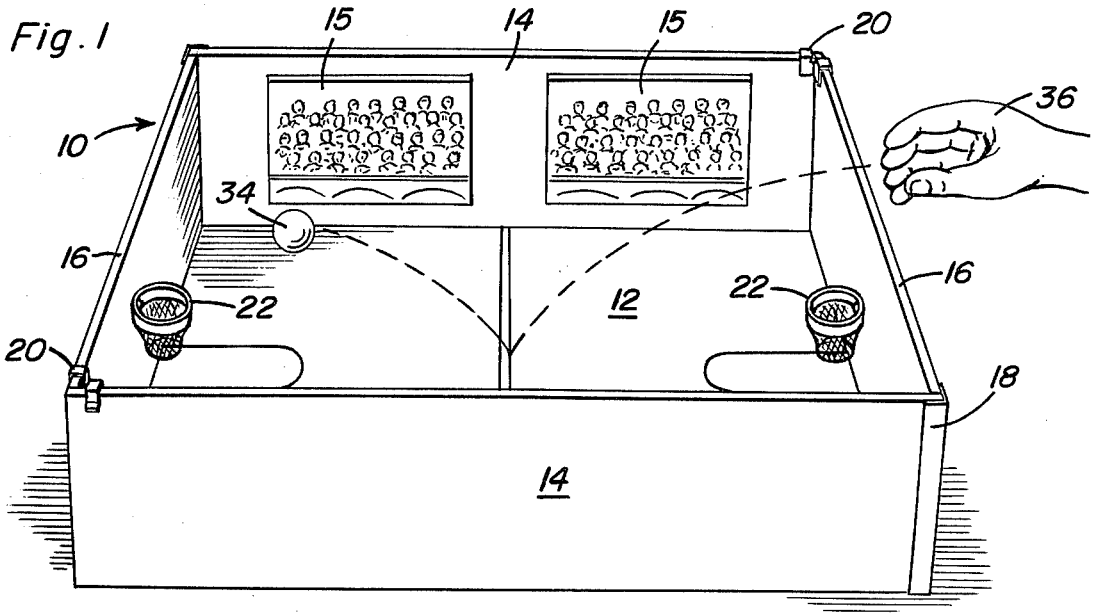
FIG. 1 is a perspective view of the game of the present invention as it would appear in use.
Figure 2:
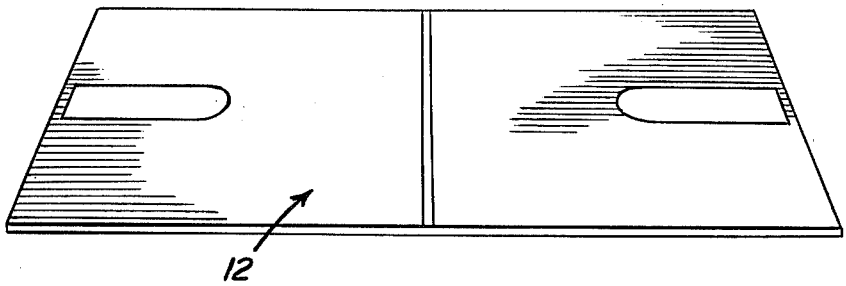
FIG. 2 is a perspective view of the game board of the present invention.

Referring now to the figures of the drawing, the game apparatus of the present invention is generally referred to by the numeral 10. The apparatus comprises a game board 12, as seen in FIGS. 1 and 2. The game board 12 consists of a rectangular planar hard surface, such as cardboard, plastic, metal, or any other suitable material. The game board 12 has markings as shown which serve to designate certain areas of a standard basketball court such as a midline which divides the court into a front court and a back court and a three second lane adjacent each goal.

Figure 3:
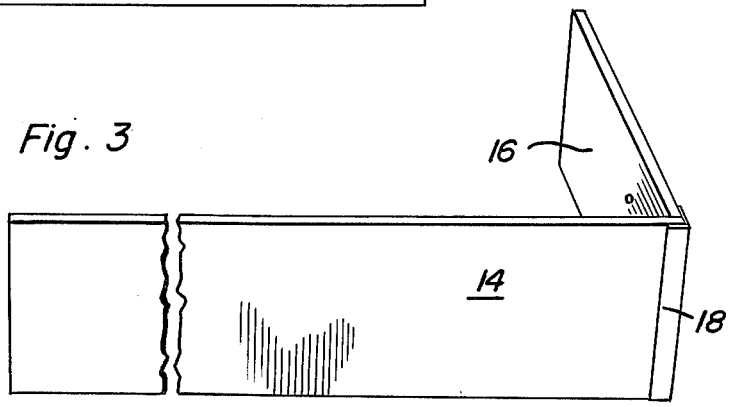
FIG. 3 is a perspective view of one pair of walls as connected for use with the game board.

Two sets of upstanding walls as shown in FIG. 3 are provided to surround the game board. As seen in FIG. 1, wall 14 has a length equal to the length of the game board 12. Wall 16 has a length equal to the width of the game board. Walls 14 and 16 are preferably attached at their corners by flexible tape 18. The use of this flexible tape 18 allows the walls to be positioned parallel to one another in a flat folded up configuration for storage.

Figure 4:
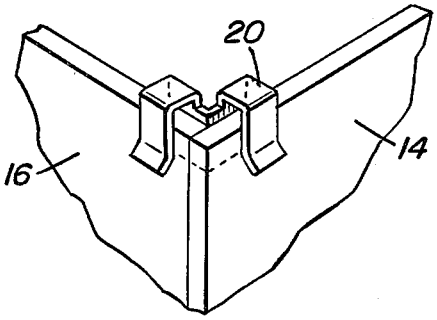
FIG. 4 is a perspective view of the attachment device for attaching two pairs of walls as shown in FIG. 3.

These walls may also be made of any suitable hard material, such as cardboard, plastic, metal or any other material from which a ball may be bounced. The two sets of walls as provided are attached at the ends thereof to each other by means of angle clips 20 as shown in FIGS. 1 and 4. These angle clips 20 serve to orient two walls 14 and 16 in a 90° relation to each other for disposition about the periphery of game board 12. By the use of these clips, the game board may be quickly put together or dismantled and stored in a convenient fashion.

Decorative markings may be included on the walls. For instance, simulated fans, as shown at 15, may be provided by attaching printed pictures to the walls. Any other marks or colors may be used as desired.

Figure 5:
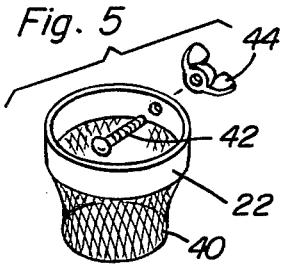
FIG. 5 is a group perspective view of the hoop, net and fastening assembly therefor.

Additionally, basketball type hoops 22, with depending baskets or nets 40 are provided for attachment to end walls 16. These hoops 22 may be attached by the use of screw threaded means with nuts, glue, or any other suitable attachment device. The hoops 22 are attached to end walls 16 at a central location along the length of the wall and at any desired height by the use of a screw 42 and wing nut 44 as shown in FIG. 5. The hoops may preferably be made of a plastic material, however, any other suitable material will serve as well.

Figure 6:
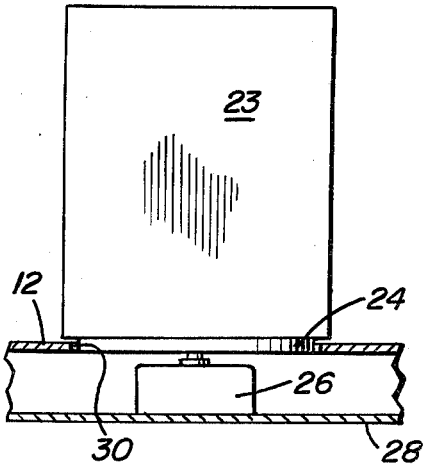
FIG. 6 is an elevation view of an optical rotating wall for use with the game.

Additionally, to add interest to the game, a rotating wall 23, as shown in FIG. 6, may be included in the game apparatus 10. Rotating wall 23 is attached to a base 24, which base is attached to and rotated by an electric motor 26. It will be understood that if the game apparatus is to include a wall such as wall 23, game board 12 as shown in FIG. 5 must be disposed above a base 28 on which motor 26 is to be attached. Such a base would extend beneath the entire area of game board 12 and serve to support game board 12 at a height sufficient to contain motor 26 and a switch for the motor. In order to incorporate rotating wall 23 into the game apparatus 10, an aperture 30 of circular configuration must be included in game board 12. One or more walls 23 may be included in game board 12 at any desired location by the producer of the game. For instance, one rotating wall 23 may be located in the longitudinal and lateral center of game board 12 to provide an obstacle to the shooting of baskets.

In play, a ball 34, made of rubber, hollow plastic, or any other suitably resilient material such as a conventional table tennis ball, is thrown by a contestant shown in FIG. 1 as hand 36 over one of the end walls 16 of the apparatus. The contestant attempts to make the ball bounce as many times as he can off of the game board 12 or any of the walls 14 or 16, and then enter basket 22. The shooting playing receives one point for having the ball go through the basket 22 and receives one additional point for each bounce made by the ball prior to entering the basket.

The rules, as contemplated for use with the invention, include a toss of a coin to determine the team or player who is to shoot first. The players then position themselves on opposite ends of the court and alternately shoot ball 34 toward the basket on the opponent's end of the court. Play continues in this manner for five minutes, whereupon the players change ends on the game board and play for another five minutes. After four five minute periods, the score for each team or player is totalled and the team or player with the greater total is declared the winner. When a player is shooting a ball at a basket, his hand may not extend over wall 16 onto the playing field, otherwise his score for that ball thrown will not count. Various other rules, trick shots and the like may be used in playing different games. For example, a series of required shots may be required such as the ball being bounced on the court in both the back court and front court before entering the hoop or bounced first in the back court, then banked off the side wall or end wall (backboard) before entering the hoop. Playing of various games will develop manual dexterity of the players and develop a better understanding of a bouncing ball, spin characteristics imparted to a ball and the like.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A game apparaus of the type wherein a ball is thrown toward a target area comprising:

a game board having a planar configuration with a smooth hard surface;

end walls for perpendicular orientation to the ends of the game board each of said end walls being of constant height;

side walls for perpendicular orientation to the sides of the game board each of said side walls being of constant height, said side walls and said end walls being of equal height;

a hoop mounted on each end wall for disposition over the game board;

a resilient ball for bounding off the game board and walls and passing through the hoops; and wherein one end wall and one side wall are hingedly interconnected for folding the side-by-side relation for storage and to perpendicular relation to be positioned alongside the side and end edge of the game board, and clip means comprising a right angle clip engaging the ends of an end wall and side wall remote from the hinged connection to retain the side and end walls in upstanding peripherally encircling relation to the game board to provide surfaces from which the ball may be banked through the hoops.

2. The apparatus defined in claim 1 wherein said right angle clip comprises an inner surface including two angularly oriented sections, each section being connected to a separate bight portion, each bight portion being connected to an outer depending leg, said right angle clip being adapted to slide over the top edge of two angularly oriented walls to be connected.

3. The apparatus defined in claim 2 and further including threaded fasteners, one threaded fastener extending through each of said hoops and one of said side walls for mounting said hoops to said side walls, each threaded fastener including one wing nut.

* * * * *